US008567511B2

(12) United States Patent
Loree

(10) Patent No.: US 8,567,511 B2
(45) Date of Patent: Oct. 29, 2013

(54) METHOD AND APPARATUS FOR RUNNING CASING IN A WELLBORE WITH A FLUID DRIVEN ROTATABLE SHOE

(76) Inventor: Randle Mackenzie Loree, High River (CA)

( * ) Notice: Subject to any disclaimer, the term of this patent is extended or adjusted under 35 U.S.C. 154(b) by 288 days.

(21) Appl. No.: 13/155,742

(22) Filed: Jun. 8, 2011

(65) Prior Publication Data

US 2012/0312551 A1 Dec. 13, 2012

(51) Int. Cl.
*E21B 19/16* (2006.01)

(52) U.S. Cl.
USPC ..... 166/376; 166/242.8; 166/177.4

(58) Field of Classification Search
USPC ..... 166/376, 285, 177.4, 242.8; 175/171
See application file for complete search history.

(56) References Cited

U.S. PATENT DOCUMENTS

| | | | | |
|---|---|---|---|---|
| 6,446,725 | B2 * | 9/2002 | Cabot | 166/286 |
| 7,275,605 | B2 * | 10/2007 | Smith et al. | 175/57 |
| 7,849,927 | B2 | 12/2010 | Herrera | |
| 2010/0032170 | A1 | 2/2010 | Howett et al. | |

* cited by examiner

*Primary Examiner* — William P Neuder
(74) *Attorney, Agent, or Firm* — Kyle R. Satterthwaite; Ryan W. Dupuis; Ade & Company Inc.

(57) ABSTRACT

Apparatus for running a casing string into a wellbore features a housing arranged for coupling to the casing string in fluid communication with an interior thereof, a shoe rotatably supported at a lower end of the housing, and a drive mechanism. The drive mechanism features a shaft extending internally along the housing toward the upper end thereof from a connection of the shaft to the shoe, and a ribbon coiling around and along the shaft toward the shoe in a manner radially spaced from the shaft above the connection thereof to the shoe. The ribbon drive rotations of the shaft through action of a fluid on said ribbon under pumping of said fluid through the housing from the casing. The drive mechanism thus employs a simple structure of a rotor assembly spinning within the housing, without requiring an additional stator or housing-carried vanes.

17 Claims, 5 Drawing Sheets

METHOD AND APPARATUS FOR RUNNING CASING IN A WELLBORE WITH A FLUID DRIVEN ROTATABLE SHOE

FIELD OF THE INVENTION

The present invention relates generally to drilling and completion of wellbores, and more particularly to use of a fluid-driven rotatable shoe at a bottom end of a casing string to cut or mill away obstructions in the wellbore that may otherwise interfere with, or prevent, the casing string from reaching the desired depth.

BACKGROUND OF THE INVENTION

In the oil and gas production industry, wellbores drilled into the earth to access hydrocarbons from subsurface formations are typically lined with metal tubulars lowered into the wellbore in an assembly of tubulars connected end to end to form a string. Such wellbore lining is generally referred to as casing, and is typically cemented into place once a desired depth has ben reached. Often, after such installation of a first casing string, the depth of the wellbore is extended by drilling a smaller bore through the bottom of the cemented-in casing. Further casing of smaller diameter than the first can then be run into the second bore through the first section of casing and then cemented in place in a similar process.

When running casing into a previously drilled wellbore, a casing string may encounter obstructions preventing it from reaching the desired depth, such as ledges, collapsed borehole sections, or other discontinuities of the wellbore.

Accordingly, there have been publications proposing to cut or mill away such obstructions during running of a casing string driving a rotatable casing shoe that is carried on the bottom end of the casing string and equipped with cutting edges or abrasive elements.

U.S. Pat. No. 7,849,927 and U.S. Patent Application Publication No. 2010/0032170 disclose such solutions, in which the rotatable shoe and the fluid-operated drive mechanism for same are sacrificial, i.e. intended to be left downhole during cementing of the casing string, and are drillable, soluble or degradable so as not to prevent further drilling of the wellbore past the bottom of the cemented casing.

Applicant has developed an improved rotatable shoe and drive configuration which can be used to reduce the parts and complexity of the fluid-operated drive mechanism and recover components thereof from downhole, thereby potentially lowering the cost of such a sacrificial tool.

SUMMARY OF THE INVENTION

According to a first aspect of the invention there is provided an apparatus for running a casing string into a wellbore, the apparatus comprising:

a housing arranged at an upper end for coupling to a bottom end of the casing string in a manner fluidly coupling an interior of the housing with an interior of the casing;

a shoe rotatably supported at a lower end of the housing;

a drive mechanism comprising a shaft extending internally along the housing toward the upper end thereof from a connection of the shaft to the shoe, and a ribbon coiling around and along the shaft toward the shoe in a manner radially spaced from the shaft above the connection thereof to the shoe to drive rotation of the shaft through action of a fluid on said ribbon under pumping of said fluid through the housing from the casing.

Preferably there is provided at least one fluid outlet port communicating the interior of the housing with an exterior thereof.

Preferably said at least one fluid outlet port includes at least one lower outlet port located in the shoe.

Preferably said at least one fluid outlet port includes at least one upper outlet port located in a wall of the housing.

Preferably the ribbon coils helically around the shaft.

Preferably there is provided a stabilizer coupled to an upper end of the shaft to locate an axis of said shaft within the housing.

Preferably the stabilizer comprises an outer circumference arranged to engage against an interior surface of the housing and an inner portion coupled to the upper end of the shaft, the inner portion comprising an inner opening communicating with a hollow interior of the shaft to enable fluid flow from the casing to the shoe through the shaft.

Preferably the stabilizer comprises outer openings disposed between the inner portion and the outer circumference to enable fluid flow into the interior of the housing from the casing to act on the ribbon to drive rotation of the shaft and the shoe.

Preferably the inner portion is annular around the inner opening and the stabilizer comprises radial arms extending outward from the annular inner portion between the outer openings to connect to the outer circumference.

Preferably the stabilizer comprises a fixed portion rigidly attached to the housing and a coupling engaged between the fixed portion and the shaft to allow relative rotation therebetween.

Preferably the coupling comprises a bushing.

Preferably there is provided at least one bearing mounted between the housing and one or both of the shaft and the shoe.

Preferably the shaft, the shoe and races of each bearing are drillable.

Preferably, expect for roller elements, all components of each bearing are drillable.

According to a second aspect of the invention there is provided a method for running a casing string into a wellbore, the method comprising:

running the casing string into the wellbore with a shoe at a bottom end thereof rotatably connected to the casing string by at least one bearing;

while running the casing string, rotating the shoe relative to the casing string by pumping fluid down the casing string to drive rotation of a fluid-driven rotor that is coupled to the shoe from thereabove;

when the casing string reaches a desired depth, cementing the casing string in the wellbore;

using a drill string, at least partially drilling out the fluid-driven rotor, races of the at least one bearing and the shoe; and retrieving roller elements of the bearings by circulating fluid down through the drill string and back up to surface through an annulus between the cemented casing string and the drill string to carry said roller elements back to the surface through said annulus.

BRIEF DESCRIPTION OF THE DRAWINGS

In the accompanying drawings, which illustrate exemplary embodiments of the present invention.

DETAILED DESCRIPTION

Figure 1:
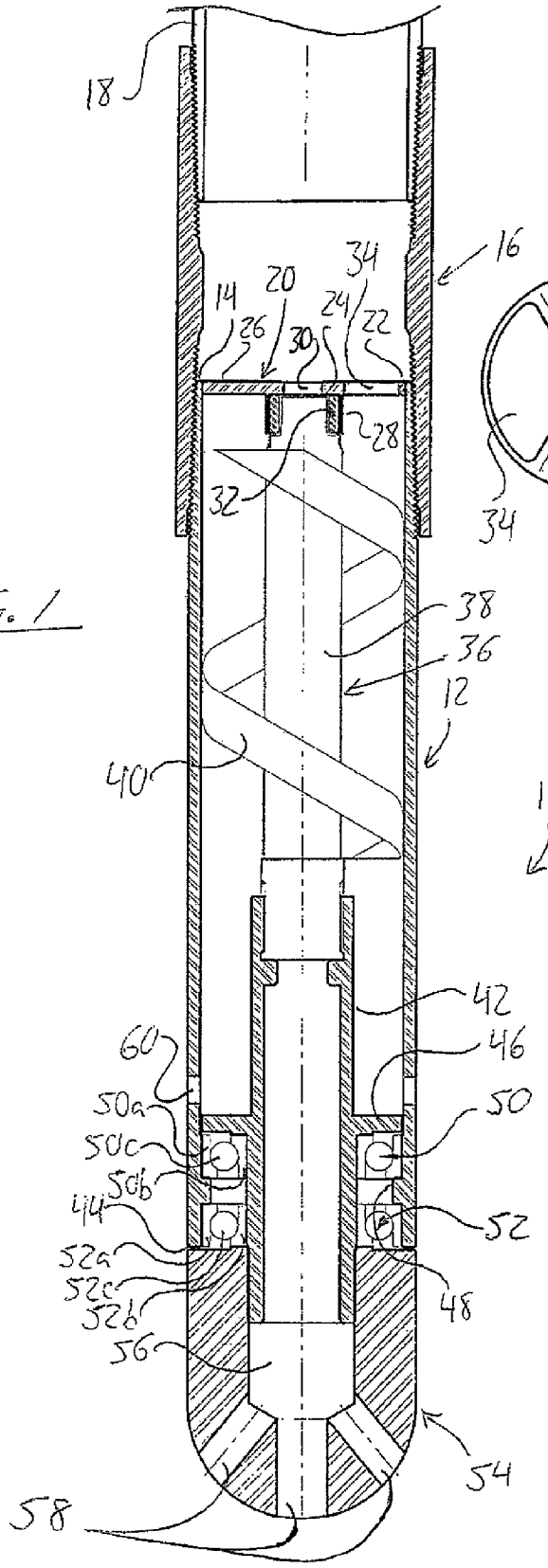
FIG. 1 is a vertical cross-sectional view of an apparatus of the present invention for clearing of wellbore obstructions while running a casing string.

FIG. 1 shows an apparatus or tool 10 of the present invention for clearing obstructions from a drilled wellbore while running in a casing string to be used to line the wellbore. The tool 10 features a hollow tubular housing 12 having an externally threaded upper end 14. A coupling 16 internally threaded at each end receives the externally threaded upper end 14 of the housing 12 from below, and threadingly engages an externally threaded bottom end of a casing string 18 above the tool 10, thereby coupling the tool housing 12 to the bottom end of the casing string 18.

Figure 2:
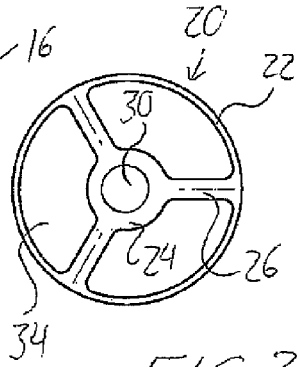
FIG. 2 is an overhead plan view of a stabilizer of a rotational drive mechanism for a rotatable casing shoe of the apparatus of FIG. 1.

A stabilizer 20 is fixed onto the upper end 14 of the housing 12 and, with reference to FIG. 2, features an outer ring 22, an inner ring 24 and a plurality radial arms 26 extending therebetween at angularly spaced positions around the inner ring 24. The outer ring 22 defines a circular outer periphery or circumference of the stabilizer that sits at the inner surface of the housing's cylindrical wall, to which the outer ring is rigidly fixed. As shown in FIG. 1, an underside of the inner ring 22 features a cylindrical collar 28 that projects downward from the plane of the radial arms 26 and outer ring 22 in a manner concentric with the inner ring 24 at a distance outward from the ring's aperture or opening 30. A bushing 32 is received and retained in the bore of the collar 28 to reside beneath the inner ring 24. In addition to the central opening 30 defined by the inner ring, the stabilizer features a plurality of outer openings 34 positioned around the inner ring between the inner and outer rings, each outer opening spanning arcuately about the inner ring between an adjacent pair of the radial arms 26.

Below the stabilizer 20, the tool 10 features a rotor 36 rotatably disposed concentrically within the housing 12. The rotor 36 features a central shaft 38 extending longitudinally on the shared axis of the casing 18 and tool housing 12, and a helical ribbon 40 coiling around the shaft 38 at a radial distance outward therefrom. Radial support arms carry the ribbon 40 on the shaft at discrete spaced apart positions along the ribbon, i.e. spaced around and along the shaft axis. The top end of the central shaft 38 is received inside the bushing 32 of the stabilizer 20 so that the shaft 38, and the helical ribbon 40 rigidly fixed thereto, are rotatable relative to the stabilizer and the surrounding tool housing 12. The rotor shaft 38 is tubular, thus having a hollow interior that is open at each end of the shaft 38. The opening at the top end of the rotor shaft 38 thus opens to the central opening 30 of the stabilizer, thereby fluidly communicating the hollow interior of the rotor shaft 38 with the interior of the casing 18 through the hollow interior passage of the coupling 16.

The rotor 36 may be formed as a single, unitary piece in which the rotor shaft 38, ribbon 40 and radial support arms therebetween are all seamlessly integral with one another, for example by machining the rotor from a single piece of stock material. The term ribbon is used to denote the shape of the helical element as a relatively thin band of material coiling around the rotor shaft, and is not intended to denote that this element is a flexible member. Rather, the rotor is made of a material that is sufficiently strong and rigid to be self-supporting and shape-consistent during use the tool to run in a casing string, but yet is drillable using available drill string bits for reasons described herein below. Known materials suitable for such application include aluminum, and drillable alloys and lower grade steels. In the illustrated embodiment, the inner and outer surface of the helical ribbon facing toward the shaft and the housing respectively are each axially oriented surfaces, i.e. parallel to the shaft axis in a direction moving downward therealong, but other embodiments may feature variations of the ribbon shape or orientation while still coiling around and downward along the shaft in a manner rotating the shaft under the action of fluid being pumped downwardly past the ribbon inside the housing.

Fixed to the bottom end of the rotor shaft 38 is a driven shaft 42 that continues from the rotor shaft 38 downward along the common longitudinal casing and tool axis. Like the rotor shaft 38, the driven shaft 42 is tubular to allow fluid to flow longitudinally through it. The hollow interiors of the two shafts 38, 42 communicate with another through their connection at the top end of the driven shaft 42. The driven shaft 42 extends downward past the bottom end 44 of the tool housing 12, and at a distance upward from the housing's bottom end 44, features a annular flange 46 projecting radially outward around the circumference of the shaft to position the circumference of the flange adjacent the inner surface of the tool housing 12. In another embodiment, the assembling of two separate shaft sections may be avoided by instead employing a single, unitary, seamlessly integral shaft in place of the two interconnected shafts of the illustrated embodiment.

Below the shaft flange 46, an annular rim 48 of the housing 12 juts a short distance radially inward from the inner surface of the housing's cylindrical wall toward the driven shaft 42. The rim 48 is relatively small so as to leave an open annuls between the inner extent of the rim 48 and the outer periphery of the driven shaft 42. Seated atop the rim 48 between the rim's annular upper surface and the underside of the shaft flange 46 is an upper bearing 50 having its outer race 50*a* fitted against the inner surface of the housing wall and its inner race 50*b* fitted against the outer circumference of the driven shaft 42. Similarly, a lower bearing 52 situated at the underside of the rim 48 has its outer race 52*a* engaged with the inner surface of the housing wall and its inner race 52*b* engaged with the outer circumference of the driven shaft 42.

Beneath the bottom end 44 of the tool housing 12, a bullnose shaped shoe 54 is fixed to the bottom end of the driven shaft 42, and due to the rotatable support of the rotor shaft 38 and driven shaft 42 by the stabilizer bushing 32 and upper and lower bearings 50, 52, the shoe is rotatable relative to the housing 12, together with the two shafts. The upper end of the shoe 54 features a central internal bore 56 into which the bottom end of the driven shaft 42 is fitted. The open bottom end of the hollow driven shaft 42 opens into the central bore 56 of the shoe 54, and a plurality of lower outlet ports 58 each extend downward from the central interior bore 56 to the exterior of the shoe 54 at the rounded lower end thereof. Higher up the tool, upper outlet ports 60 extend through the wall of the housing 12 above the flange 46 of the driven shaft 42.

Figure 3:
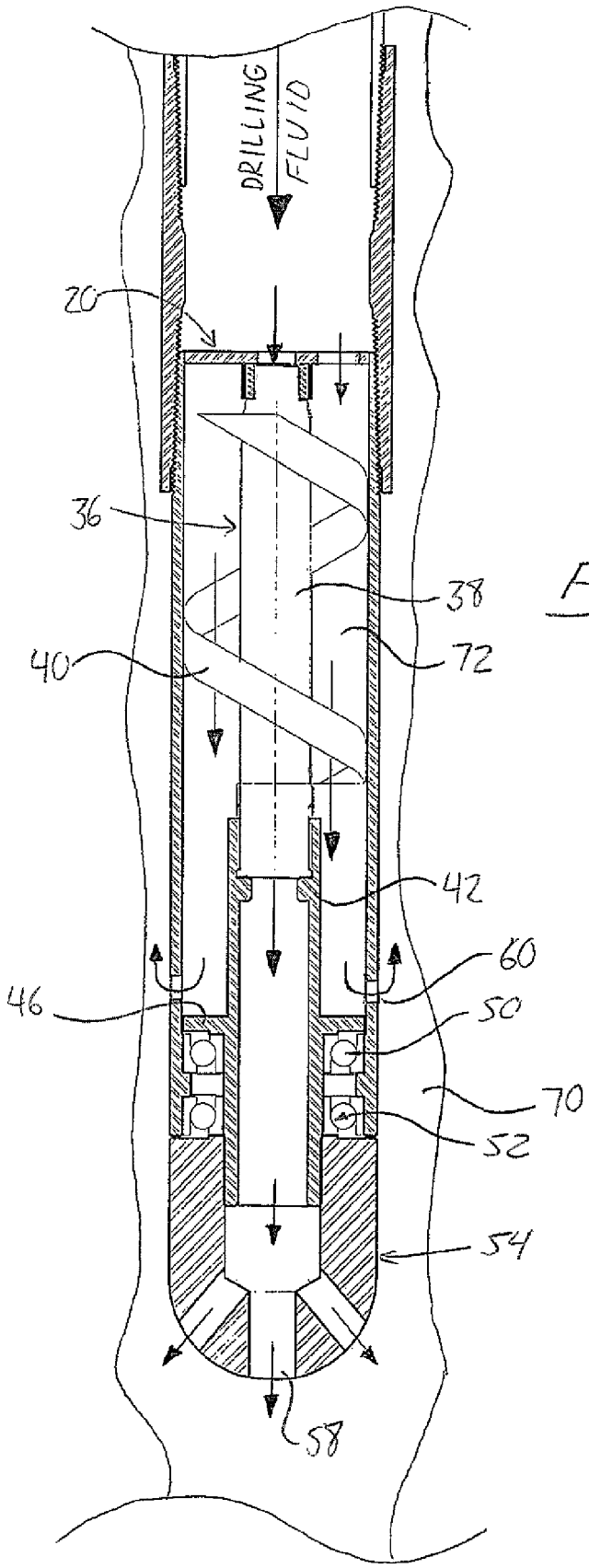
FIG. 3 is a schematic vertical cross-sectional view of the apparatus of FIG. 1 during running in of the casing string.

With reference to FIG. 3, during running of the casing string 18 into a wellbore 70, fluid is pumped down to the tool 10 through the inner bore of the casing string 18, where some of the fluid passes through the central opening 30 of the stabilizer 20 into the rotor shaft 38, and onward therefrom through the driven shaft 42 into the shoe 54, where the fluid exits the tool through the lower outlet ports 58 at the tip of the shoe. The rest of the fluid from the casing string 18 enters the tool housing 12 through outer openings 34 of the stabilizer 20. Moving down through the annulus 72 between the tool housing wall and the rotor shaft 38, this fluid acts on the helical ribbon 40, the downward force of the ribbon resulting in rotation of the rotor 36 in the downward coiling direction of the helical ribbon 40 (i.e. counterclockwise as viewed from above for the illustrated embodiment).

Coupled together, the driven shaft 42 and attached shoe 54 rotate together with the rotor shaft 38. The engagement of the stabilizer 20 against the inner surface of the housing wall keeps the rotor shaft 38 centered in the housing during this rotation, and the close positioning of the circumference of the flange 46 of the driven shaft at the inner surface of the tool housing likewise keeps the driven shaft 42 centered. Cutting or abrasive elements on the exterior of the shoe 54 thus cut, mill or abrade away material the shoe runs into or brushes against during its decent in the wellbore. The fluid having acted on the rotor 36 exits the housing 12 of the tool 10 at the upper outlet ports 60, from where the pumping pressure circulates it back up to surface through the annulus between the casing string and the surrounding wall of the wellbore. The other stream of fluid existing the tool through the lower outlet ports 58 in the shoe 54 dislodges or clears away cuttings or loosened material freed from the wellbore obstruction acted on the by the cutting, milling or abrading shoe 54.

Figure 4:
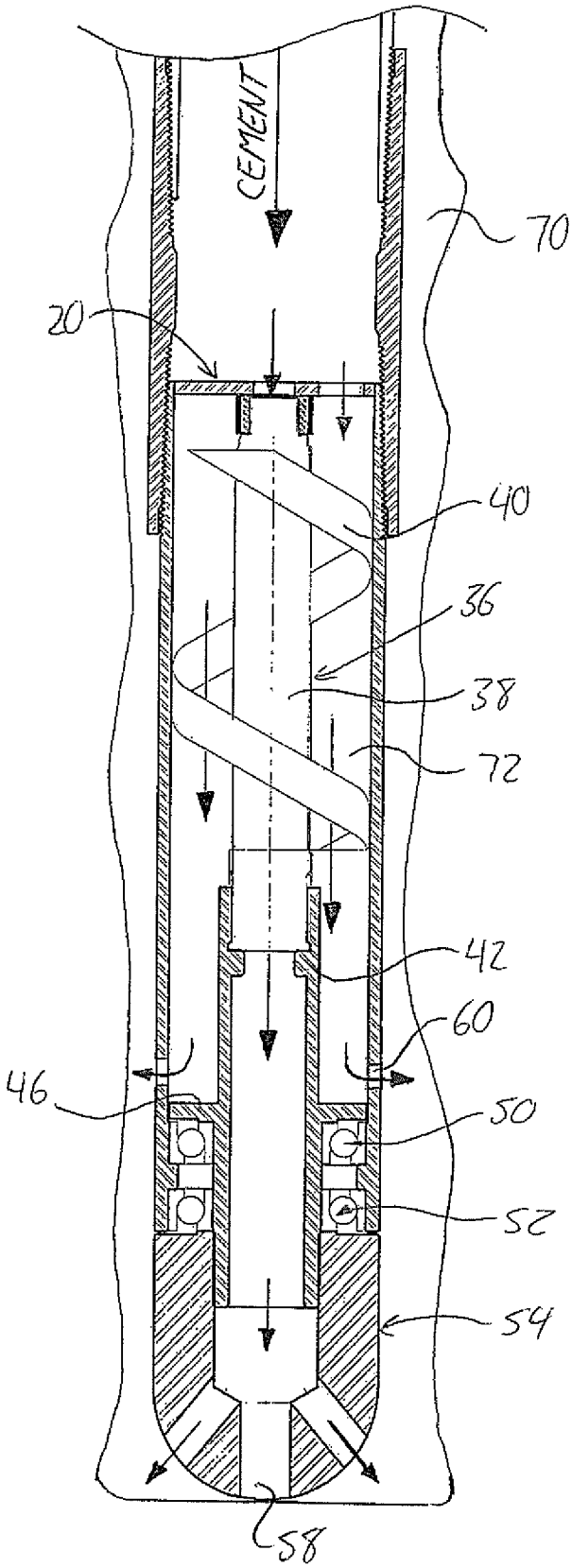
FIG. 4 is a schematic vertical cross-sectional view of the apparatus of FIG. 1 during cementing in of the casing string.
Figure 5:
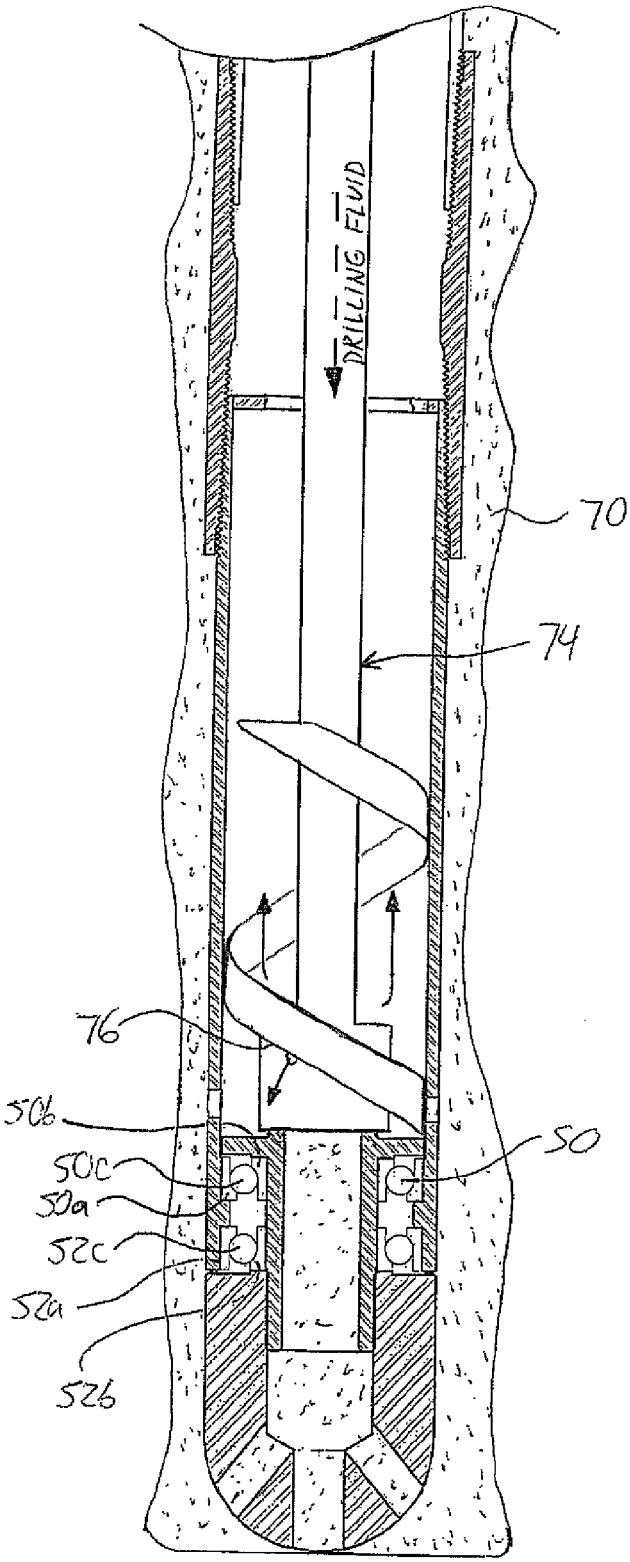
FIG. 5 is a schematic vertical cross-sectional view of the apparatus of FIG. 1 during drilling out thereof after cementing of the casing string.

With reference to FIG. 4, once the casing string has been run to a desired depth, the circulation of fluid is ceased, and cement is instead pumped down the casing string, where through the ports 58, 60 of the tool 10, it fills the bottom of the well bore and builds up inside the annular space outside the tool and the casing string, as well as inside the tool itself. Turning to FIG. 5, when the cement has solidified, a drill string 74 can be lowered through the cemented to drill out the tool to extend the wellbore 70 past the previously run casing to further depths. That is, the stabilizer, shafts, ribbon, bearing races and shoe are made of drillable material(s), such as aluminum, that can be drilled out with the cement that has hardened inside the tool housing 12. During such drilling, the hardened cement inside the tool housing holds these components stationary against the rotational action of the drill string so that the drill bit 76 will work away these components rather than simply rotate them with the drill string after initial engagement by the working tip of the drill bit.

For strength during use of the tool, the roller elements 50*c*, 52*c* of the bearings 50, 52 may be made of a harder, stronger material that is not readily or easily drillable like the rotor 36, driven shaft 42, shoe 54 and bearing races. During drilling out of the tool 10, the bearing races and driven shaft located inward thereof will be broken up by the drilling action, thus releasing the roller elements of the bearings under advancement of the drill bit in the downhole direction. IN the illustrated embodiment, the bearings, drill string and casing string are selected in a combination providing appropriate relative sizing between the bearing roller elements, the drill string outer diameter and the casing string inner diameter to allow production of the bearing roller elements to surface in the annular space between the drill string and the surrounding casing. That is, with reference to FIG. 6, when the drilling process has dislodged the bearing roller elements 50*c*, 52*c* from the bearing races, circulation of fluid down through the drill string and back up to surface through this annulus can carry the freed bearing roller elements back up to the surface for recovery.

Figure 6:
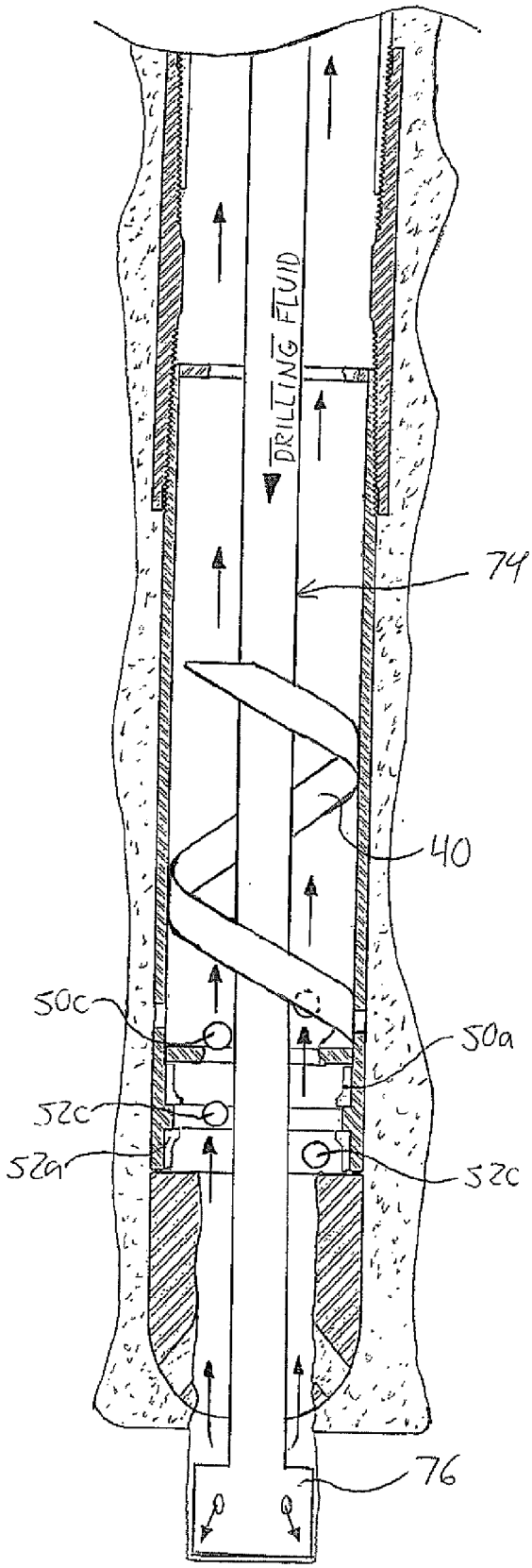
FIG. 6 is a schematic vertical cross-sectional view of the apparatus of FIG. 1 after drilling fully therethrough to extend the wellbore to a further depth.

In the illustrated embodiment, the drill bit 76 is sized to drill away the rotor shaft, the driven shaft and the inner races of the bearings, and the drill string shaft is smaller by an amount sufficient to accommodate the bearing roller elements in the in the annular space between the drill string shaft and any remnants of the drilled away components that may remain, for example including the helical ribbon 40 and remnants of the helical ribbon support arms on the rotor shaft and of the flange 46 of the driven shaft. The illustrated helical ribbon 40 occupies nearly the full inside diameter of the tool housing, and so drilling away the rotor shaft and parts of the ribbon support arms thereon leaves the helical behind, as shown in FIGS. 5 and 6. However, the ribbon is still preferably made of drillable material so as not to interfere with the drilling operation under contact thereof by the drill bit.

Drillable, rotatable casing shoes are known in the prior art, and accordingly limited detail is provided herein on the shoe of the tool, as different shoe shapes, structures, materials and cutting/milling/abrading elements may be employed, including those known from the prior art documents identified in the background section above, and other references that disclose rotatable drilling shoes that are used to actually drill the wellbore with the casing to avoid the need to first trip use a separate drill string to pre-form the wellbore before running the casing. In a known manner, the shoe may employ hard material at the outer circumference thereof for cutting performance, while using a softer readily drillable material for the central portion of the shoe that directly underlies the casing bore. In the illustrated embodiment, the maximum outer diameter of the shoe 54 is equal to the outer diameter of the cylindrical tool housing, which is also equal to the outer diameter of the casing. In other embodiments, the maximum outer diameter of the shoe 54 may be somewhat larger than the casing and tool diameter, for example equal to or slightly larger than the outer diameter of the casing-tool coupling 16, which in the illustrated embodiment is slightly larger than the casing and tool housing.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. Apparatus for running a casing string into a wellbore, the apparatus comprising:

a housing arranged at an upper end for coupling to a bottom end of the casing string in a manner fluidly coupling an interior of the housing with an interior of the casing;

a shoe rotatably supported at a lower end of the housing;

a drive mechanism comprising a shaft extending internally along the housing toward the upper end thereof from a connection of the shaft to the shoe, and a ribbon coiling around and along the shaft toward the shoe in a manner radially spaced from the shaft above the connection thereof to the shoe to drive rotation of the shaft through action of a fluid on said ribbon under pumping of said fluid through the housing from the casing.

2. The apparatus of claim 1 comprising at least one fluid outlet port communicating the interior of the housing with an exterior thereof.

3. The apparatus of claim 2 wherein said at least one fluid outlet port includes at least one lower outlet port located in the shoe.

4. The apparatus of claim 2 wherein said at least one fluid outlet port includes at least one upper outlet port located in a wall of the housing.

5. The apparatus of claim wherein the ribbon coils helically around the shaft.

6. The apparatus of claim 1 comprising a stabilizer coupled to an upper end of the shaft to locate an axis of said shaft within the housing.

7. The apparatus of claim 6 where the stabilizer comprises an outer circumference arranged to engage against an interior surface of the housing and an inner portion coupled to the upper end of the shaft, the inner portion comprising an inner opening communicating with a hollow interior of the shaft to enable fluid flow from the casing to the shoe through the shaft.

8. The apparatus of claim 7 wherein the stabilizer comprising outer openings disposed between the inner portion and the outer circumference to enable fluid flow into the interior of the housing from the casing to act on the ribbon to drive rotation of the shaft and the shoe.

9. The apparatus of claim 8 wherein the inner portion is annular around the inner opening and the stabilizer comprises radial arms extending outward from the annular inner portion between the outer openings to connect to the outer circumference.

10. The apparatus of claim 6 wherein the stabilizer comprises fixed portion rigidly attached to the housing and a coupling engaged between the fixed portion and the shaft to allow relative rotation therebetween.

11. The apparatus of claim 10 wherein the coupling comprises a bushing.

12. The apparatus of claim 1 comprising at least one bearing mounted between the housing and one or both of the shaft and the shoe.

13. The apparatus of claim 12 wherein the shaft, the shoe and races of each bearing are drillable.

14. The apparatus of claim 13 wherein, expect for roller elements, all components of each bearing are drillable.

15. Method for running a casing string into a wellbore, the method comprising:

running the casing string into the wellbore with a shoe at a bottom end thereof rotatably connected to the casing string by at least one bearing;

while running the casing string, rotating the shoe relative to the casing string by pumping fluid down the casing string to drive rotation of a fluid-driven rotor that is coupled to the shoe from thereabove;

when the casing string reaches a desired depth, cementing the casing string in the wellbore;

using a drill string, at least partially drilling out the fluid-driven rotor, races of the at least one bearing and the shoe; and retrieving roller elements of the bearings by circulating fluid down through the drill string and back up to surface through an annulus between the cemented casing string and the drill string to carry said roller elements back to the surface through said annulus.

16. The method of claim 15 wherein the fluid-driven rotor comprises a shaft that is coupled to the shoe and is rotatable relative to the casing string, and a ribbon coiling around and along the shaft toward the shoe in a manner radially spaced therefrom.

17. The method of claim 16 wherein the ribbon coils helically around and along the shaft.

* * * * *